United States Patent [19]

Bakker

[11] 4,111,212

[45] Sep. 5, 1978

[54] DOSING AND WEIGHING OF CUT TOBACCO

[75] Inventor: Jouke Bakker, Joure, Netherlands

[73] Assignee: Douwe Egberts Tabaksmaatschappij B.V., Joure, Netherlands

[21] Appl. No.: 384,814

[22] Filed: Aug. 2, 1973

[30] Foreign Application Priority Data

Aug. 9, 1972 [GB] United Kingdom .....37114/72
Oct. 25, 1972 [GB] United Kingdom .....49199/72

[51] Int. Cl.[2] ..... A24C 1/02

[52] U.S. Cl. ..... 131/21 A; 131/21 C; 131/22 A; 131/109 R; 131/110

[58] Field of Search ..... 131/21 A, 21 R, 21 C, 131/22 A, 22 R, 108 R, 109 R, 110, 109 B; 177/123, 120, 121; 222/56, 370, 196

[56] References Cited

U.S. PATENT DOCUMENTS

| | | | |
|---|---|---|---|
| 3,196,880 | 7/1965 | Pinkham | 131/109 R X |
| 3,468,459 | 9/1969 | Bonneric | 131/22 R UX |
| 3,491,770 | 1/1970 | Rudszinat et al. | 131/110 X |
| 3,561,552 | 2/1971 | Rischke | 177/120 |
| 3,586,211 | 6/1971 | Bonneric | 222/56 |
| 3,703,902 | 11/1972 | Sargrove | 131/22 A |
| 3,707,153 | 12/1972 | Brunhorn et al. | 131/22 A |

FOREIGN PATENT DOCUMENTS

| | | | |
|---|---|---|---|
| 826,914 | 1/1938 | France | 131/109 R |
| 6,414,842 | 6/1965 | Netherlands | 131/22 A |

*Primary Examiner*—John F. Pitrelli
*Attorney, Agent, or Firm*—Baldwin, Egan, Walling & Fetzer

[57] ABSTRACT

A method and apparatus for dosing and weighing "shag" tobacco comprising the steps of dosing an approximate quantity of tangled long fibre tobacco, which is less than the required quantity, and subsequently dosing disentangled long fibres to make up the approximate quantity to the required quantity of long fibres. Thus the quantity of short fibre tobacco added thereto to obtain the quantity nominally required per package can every time be equal.

16 Claims, 3 Drawing Figures

DOSING AND WEIGHING OF CUT TOBACCO

Figure 1:
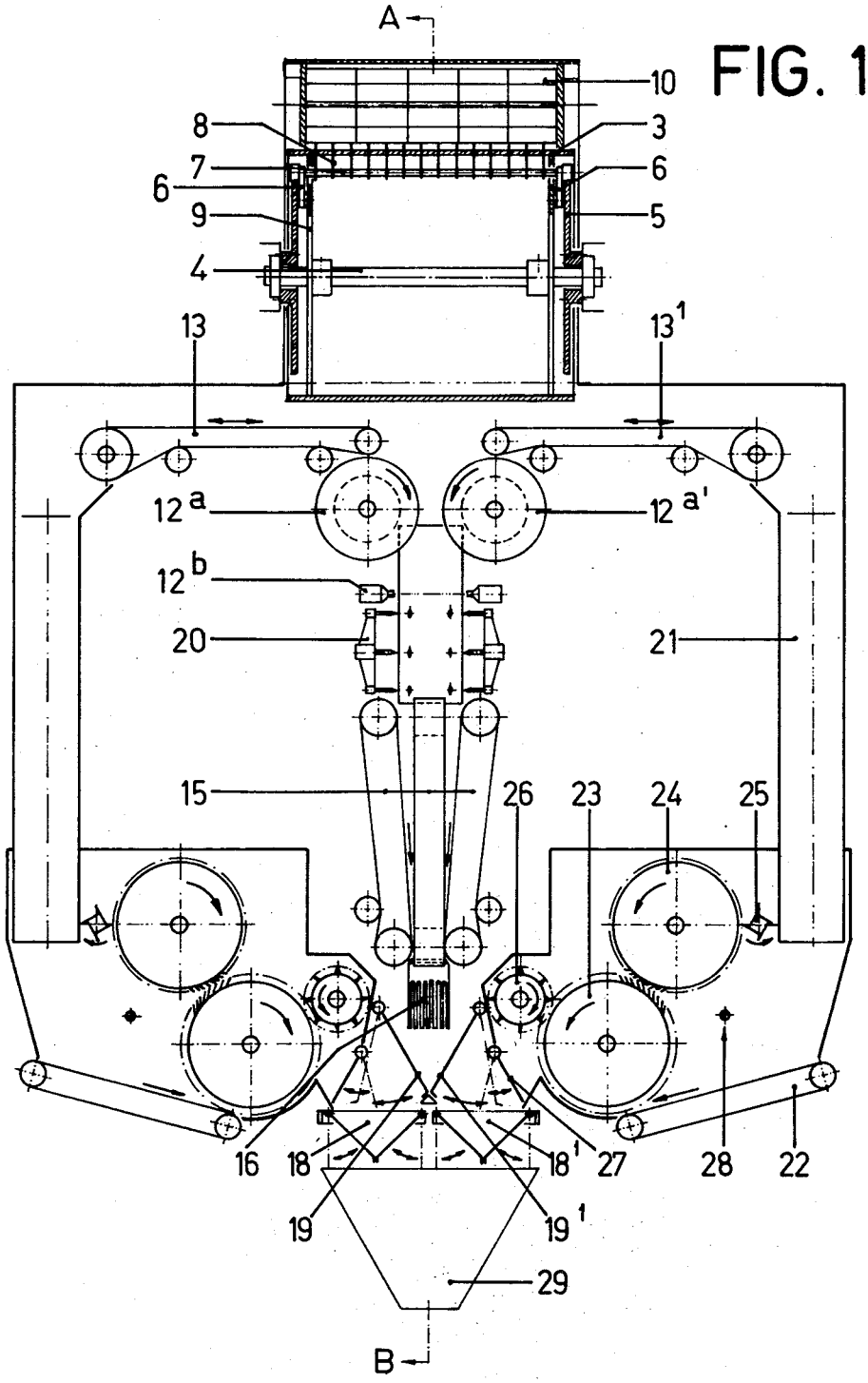

The present invention relates to a method and apparatus for dosing tobacco fibres with predetermined quantities of long and short fibres. In the manufacturing to tobacco products such as "roll your own" tobacco, also called "shag" tobacco, or such as pipe tobacco, it is necessary to provide for units having accurately predetermined quantities of long and short fibres. This has to be accomplished although the doses must be taken from a tangled mass of long and short fibres with — sometimes widely — varying proportions of one to the other.

The starting material is obtained by cutting the fermented and/or otherwise variously treated tobacco leaves in a direction perpendicular to the main nerve. It is obvious that, in this process, fibres of widely different lengths will be formed, if only because of the very shape of the leaves. In the further processing the longer fibres tend to intertwine and to form a tangled mass. The shorter fibres are loosely held in the tangled and tend to disengage from the mass when handled. In the following when speaking of "short fibres" we mean precisely those which disengage in this way.

In shag tobacco the long fibres are best for rolling cigarettes. Notwithstanding the fact that the short fibres will separate out in the container (e.g. a plastic or a paper pouch), the consumer does tolerate a certain quantity of shorts. If of a parsimonious nature he will use this quantity to "fill up" the cigarette and he will develop a certain routine in doing this.

He does not, however, like to be confronted with quantities of short fibres which vary considerably from package to package. Another requirement is of course that every package contains a certain guaranteed weight of tobacco.

As different batches of tobacco leaves yield varying percentages of short fibres it follows that in an attempt to provide each package sold to the customer with accurately predetermined quantities of long and short fibres, these have to be measured out separately. This again means that first of all the long and short fibres in the aforementioned tangled mass of fibres have to be separated. This can easily be done e.g. by agitating the mass over a sieve.

The automatic dosing of short fibres is comparatively easy. This is always so when substances, as in this case, are composed of a loose mass of small units. Volumetric as well as gravimetric methods can be used.

The situation is quite different with the long fibres which, as said before, are presented in the form of a tangled mass. One method to overcome the difficulty is to disentangle the mass of fibres e.g. by a "carding" process. Accurate dosing is much easier then. A major disadvantage is, however, that in the process of disentanglement, a certain portion of the fibres is broken into less valuable short fibres.

Another method is to compact the mass of long fibres into a strand of fixed cross-section, such as a rectangle or a square of e.g. 6 × 6 cm, and to cut off a certain length of said strand for each dose. This is in fact a volumetric dosing method which, due to the unavoidable lack of absolute homogenity of the strand and the limited accuracy of the process in which a predetermined length of the strand is disengaged, is by no means sufficiently accurate for our purpose. By this method breakage of the long fibres is substantially avoided.

When this method of volumetric dosing of the long fibres is used, the variations in the quantity of these in each package have to be compensated by variations in the quantity of short fibres (in order to obtain the guaranteed net quantity in each package). In the case of "shag", in order to avoid that the customer should sometimes find much too high a percentage of short fibres in his package, the average quantity of long fibres in the packages has to be adjusted to a higher level than when the long fibres could be dosed in a more accurate manner. Even the latter case the disadvantage of varying quantities of short fibres in the packages remains.

In accordance with a first aspect of the present invention a method of dosing long fibres comprises the steps of providing an appproximate quantity of tangled long fibres, said approximate quantity being less than the quantity required, and subsequently providing a sufficient quantity of disentangled long fibres to make up said approximate quantity to the required quantity. It has been found that this method substantially overcomes the disadvantages described above.

In accordance with a further aspect of the present invention a method of dosing tobacco fibres from a tangled mass of long and short fibres comprises the steps of separating the short fibres from the tangled mass of long fibres, measuring out a part of the required quantity of long fibres by plucking tufts from said mass, and measuring out a sufficient quantity of disentangled long fibres to make up said required quantity.

Generally, according to what is said before, a certain amount of short fibres is also used to make up the package, so that preferably the total required weight (of the package) is reached by an accurate dosing step of short fibres additional to the dosing of long fibres just mentioned.

Preferably 85–95% of the long fibres should be dosed in the first step and 5–15% in the second dosing step. To work as efficiently as possible the following consideration has to be taken into account. If the maximum possible variation in the first dosing step of the long fibres is found to be $x$, the average quantity to be weighed out in this step has to be set at $\frac{1}{2}\times$ below the ultimately desired quantity of long fibres in each package.

In the second dosing step of the long fibres the disentanglement process will cause some fibres to be broken. These may be separated out. However, since the quantity of fibres involved in the second dosing step is only a small part of the total, the damage caused is negligable for all practical purposes, so that the separation is not absolutely necessary.

The percentage of short fibres in the package depends on what is admissable for the purpose concerned. For shag this is generally 5–10%.

In a preferred embodiment of the invention the plucking of tufts composed of long fibres from the mass of tangled fibres is accomplished in the following way. Use is made of "needles" gradually emerging from holes in a tangentially moving surface which are brought into contact with the mass as fed into the apparatus. A gradual pulling effect is obtained. Small lumps are pulled out of the mass. Preferably these lumps should be reduced in size, wiping off the material which protrudes more from the abovementioned perforated surface than the height of the needles. The needles are then gradually retracted, thus setting free the tufts which still cling to them after the superfluous material has been stripped off. Conveniently the perforated surface has the shape of a drum and the wiper is a roll, to which wooden bars have been attached. In a preferred embodiment of the invention the tufts plucked out of the tangle of long fibres are compacted into a strand as described above. The compacting can be done e.g. with — preferably four — conveyor belts mounted vertically and which enclose a space the cross-section of which gradually diminishes in the direction of the movement of the strand.

However, other methods of compacting are possible, e.g. by conveying the tufts of tobacco through a vertical tunnel of decreasing circular cross-section (e.g. as described in Dutch Patent application 7017541).

For each dosing a certain length of strand is disengaged.

This can e.g. be done by sticking a "fork" or "comb" sideways into the strand, keeping this fork in position, sticking another fork into the strand below the first one and by moving the second fork away from the first in a direction parallel to the axis of the strand. The disengaged length of strand falls into a weighing apparatus, wereupon disentangled long fibres are fed into this apparatus until the desired weight is obtained. In the embodiment of the invention in which the compacting of the fibres to a strand is accomplished by conveyer belts as described above, the conveyor belts may be stopped during the process of disengaging a certain length of strand and may be started again as soon as the dosing has taken place. The belts thus move intermittently for certain predetermined distances. The compactness (density) of the strand produced is somewhat dependent on various factors, such as humidity and origin of the tobacco. Thus it may occur that during operation of the apparatus the average weight of fibres measured out "drifts" away from the average which is actually desired. To correct this the apparatus may be equipped with an instrument which registers the deviation of the successively disengaged lengths of strand from the desired average weight and which counteracts the "drift" through feed-back control, as e.g. can be realised by the weighing instrument type nr. 3120 of the firm Boekels (Aachen, W. Germany). In the embodiment of the invention using conveyor belts for the process of compacting, this correction may conveniently be obtained by changing the distance which the belts travel before the next piece of strand is disengaged. Also the distance between the belts could be changed so as to narrow or widen the cross-section of the strand.

With regard to the preparation of the fibres for the second dosing step of the long fibres, the following can be said.

In a preferred embodiment of the invention part of the tufts prepared in the way described above are fed into a section of the apparatus provided with means to disentangle them, preferably by a "carding" process. This can e.g. be accomplished by picking up the fibres on a tangentially moving surface with numerous short needles tilted in the direction of movement and by combing the fibres swept up by these needles with a second surface likewise provided with short needles and moving tangentially in a direction opposite to that of the first surface. The "fleece" which is thus formed on the first surface is stripped off e.g. with a third surface provided with bigger needles than the two aforementioned. Conveniently the surfaces in question may be cylindrically shaped, in fact they may be drums provided with needles.

For the dosing of the short fibres several methods can be used of which the principles are known. It can e.g. be done volumetrically with a "dosing disc" as described below in the discussion of the figures. The addition of the quantity of short fibres measured out can be done after completion of the weighing of the long fibres. However it may be advantageous to add this quantity to the length of strand of long fibres measured out each time and to bring the total weight of the dose to the desired level by supplementing disentangled long fibres.

In accordance with a further aspect of the present invention an apparatus for dosing long fibres comprises means for measuring out an approximate quantity of tangled long fibres, said approximate quantity being less than the quantity required, and means for measuring out a sufficient quantity of disentangled long fibres to make up said approximate quantity to the required quantity.

In accordance with another aspect of the present invention an apparatus for dosing tobacco fibres from a tangled mass of long and short fibres comprises means for separating the short fibres from the tangled mass of long fibres, means for measuring out a part of the required quantity of long fibres, and means for measuring out a quantity of disentangled long fibres to make up said required quantity.

In a preferred embodiment of the present invention an apparatus for dosing tobacco fibres from a tangled mass of long and short fibres comprises means for separating the short fibres from the tangled mass of long fibres, means for plucking out tufts from said tangled mass of long fibres, means for compacting the tufts into a strand, means for disengaging a predetermined length of said strand, means for weighing this length of said strand, means for measuring out a weight of disentangled long fibres in dependence upon the weight of the length of said strand. Preferably, means are also provided for measuring out a predetermined quantity of short fibres.

Figure 2:
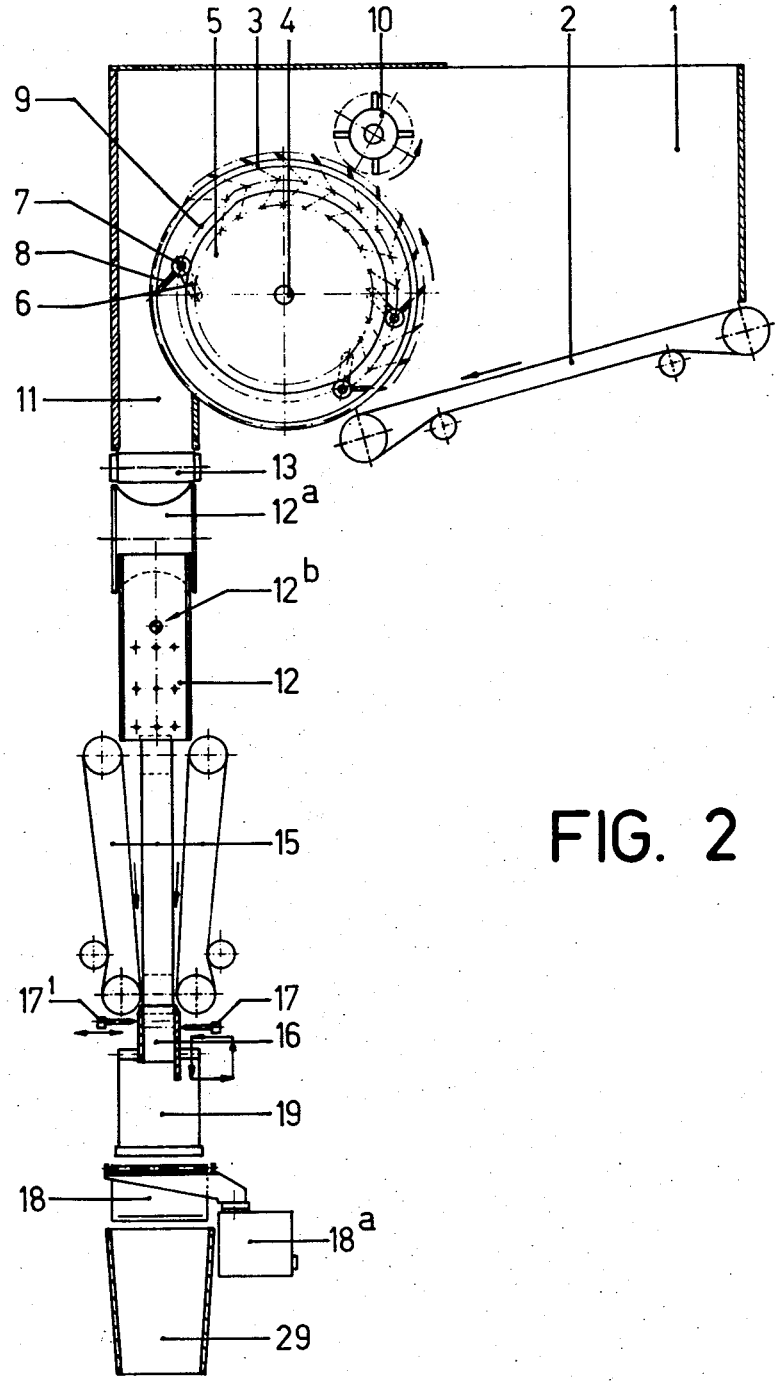
Figure 3:
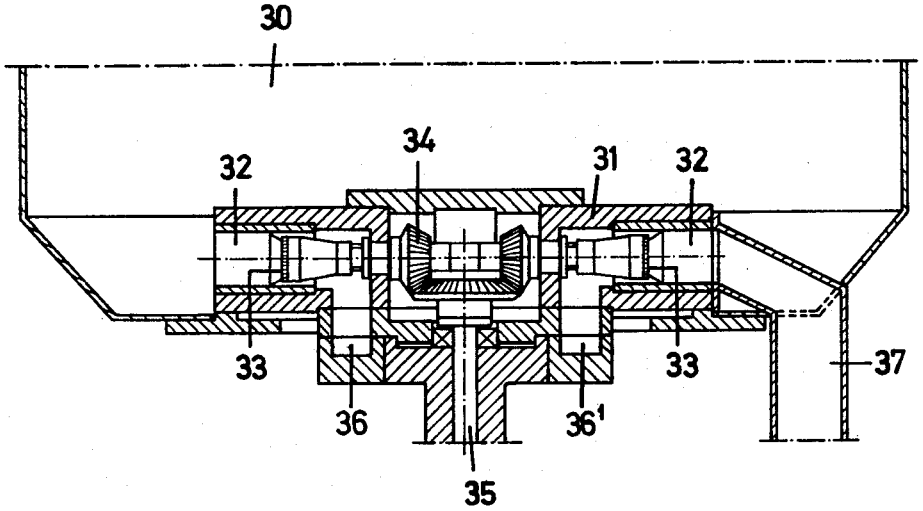

A preferred embodiment of the present invention will hereinafter be described with reference to the accompanying drawings, in which:

FIG. 1 is a "frontal" cross-section of that part of the apparatus, which is used for the first and second weighing step of the long fibres, FIG. 2 is a cross-section along the line A–B in FIG. 1, and FIG. 3 is a cross-section of that part of the apparatus by which the dosing of the short fibres is performed.

With reference to FIG. 1 and FIG. 2 the following can be said: The tobacco is fed into the hopper 1, which also acts as a buffer vessel. The conveyer belt 2 which may be driven by any suitable conventional drive in the direction indicated in FIG. 1 presses the mass against the anti-clockwise rotating perforated drum 3 with axle 4. Inside the drum 3 and at each end thereof there is a disk 9, attached to the axle of the drum and provided with short hinged arms 6. Each pair of hinged arms 6 (one attached to one of the disks, the other attached to the second disk) is linked by a bar 7 lengthwise provided with a row of needles 8. Outside the drum, there are two other disks 5. These do not rotate with the drum 3, but are at rest. The circumference of these disks 5 is not co-axial with the drum 3, but they have such a shape that on rotation of the drum 3, through the interaction of the asymmetrical disks 5 and the bars 7 the needles 8 are gradually pushed out through the perforations in drum 3 and on further rotation of the drum gradually retracted, as is shown in FIG. 2. In this way lumps of tobacco are gently pulled out of the mass in hopper 1. These lumps are still too big. For this reason the wiper roll 10 strips off all the tobacco which protrudes outside the range of the needles 8. The tufts of tobacco sticking to the needles are set free as the needles gradually retract into the apertures of the drum 3, and they fall down through the space 11.

The short tobacco fibres are separated out of the tangled mass in the hopper 1 by reason, as aforesaid, of the mass merely being disposed and falling within the hopper. They are collected on the conveyer belt 2 and are dropped through the opening between the drum 3 and the conveyer belt 2 to be transported to the part of the apparatus equipped for dosing the short fibres. The tobacco tufts set free by the needles of the drum 3, as described above, partly fall directly into the shaft 12, via the convex drums 12*a* and 12*a*[1], functioning as a feeding hopper for the compacting device. The other part falls on the conveyer belts 13 and 13[1]. These belts will move "outwards" transporting tufts to the part of the apparatus for the second weighing step of the long fibres, when this is necessary. When there is sufficient material in the feeding hoppers of these parts of the apparatus (as will be described below) the movement of the belts 13 and 13[1] is reversed, so that all the tufts fall into the feeding hopper 12 for the compacting device.

The compacting device, which forms the tufts into a strand of square-cross section, consists of four conventionally driven conveyer belts 15 enclosing a space which tapers off downwards from a 13 to a 6 cm square. The strand emerging from the compacting device enters a severing shaft 16, with vertical slits (as best seen in FIG. 1). For each dose the conveyer belts 15 travel a certain predetermined distance and stop. Immediately thereafter the "combs" 17 and 17[1] FIG. 2 are put in action, and disengage the length of strand protruding from the compacting device. The comb 17[1] is stuck into the strand, as well as just below it, the comb 17 is moved downwards. The compacting device alternately supplies two weighing boxes 18 and 18[1] FIG. 1 by interaction with the flaps 19 and 19[1]. As will become clear each of the weighing boxes 18 and 18[1] is supplied by a separate device for the second weighing step of the long fibres which will be discussed further on.

The feeding hopper 12 for the compacting belts is provided with an ultra-sonic sensing device 12*b* which controls the feed of tufts by the drum 3, stopping its rotation when there is sufficient material in the hopper 12. When for whatever reason the operation of the apparatus has to be interrupted temporarily, the weight of the tobacco in the hopper 12 might compact the material too much, so that the first lengths of strand pulled off once the machine has started running again would be too heavy. For this reason the apparatus has been provided with two sets of blocking needles 20, which are stuck into the mass in the hopper 12 as soon as the operation of the apparatus is interrupted.

One of the two identical devices for the second weighing step of the long fibres will now be described. When the conveyer belt 13[1] moves away from the axis A B of the apparatus, tobacco tufts are transported to the right of the apparatus where they fall through the vertical shaft 21 on to a tilted conveyer belt 22, which brings these tufts into contact with a counterclockwise rotating drum 23 provided with short needles (as shown in FIG. 1). The needles tear fibres from the mass, while disentangling these to a certain degree. A "fleece" is formed between the needles. To limit the thickness of this fleece the fibres protruding more than a pre-determined distance from the needles are removed by a counter-clockwise rotating drum 24, also provided with short needles. The drum 24 is cleaned by the rotating shaft 25, provided with rubber flaps.

The drum 26, interacting with the drum 23, rotates at high speed. It has been provided with sturdy needles which penetrate between the rows of needles of drum 23 and, stripping the tobacco fibres from this drum, throw them down. When the flap 27 is opened, 22, 23, 24, 25, 26 are in action feeding tobacco into the weighing box 18[1] till the pre-determined weight of long fibres has been obtained. The flap 27 is then closed and the drums stop rotating.

The direction of movement of the conveyer belt 13[1] is governed by the ultra-sonic sensing device 28. As soon as tobacco tufts reach up to this device the direction of movement is reversed, so that the feed of tufts through the hollow shaft 21 is interrupted. The weighing box 18 is attached to an electronic weighing scale 18*a* (FIG. 2). The bottom of the weighing box consists of two flaps which open when the weighing operation has been finished. The dosed tobacco falls through the funnel 29 into a container and is transported further to the packing machine. On the way to this machine the desired predetermined quantity of short fibres is added with a volumetric dosing device for short fibres which will now be described (see FIG. 3).

In a container 30 a disk 31 can revolve round a vertical axle. Cylindrical holes 32 each with a perforated piston 33 have been made in the circumference of the disk 31. The perforated piston 33 has been connected with a revolving threaded axle via a tooth gearing 34, which can be adjusted via the axle 35. In this way the depth of the cylindrical holes can be regulated. On rotation of the disk the perforated pistons 33 are first connected with the vacuum channel 36, through which short tobacco can be sucked up into the holes 32, which leads to compaction of the tobacco. On further rotation of the disk 31 the perforated pistons 33 are connected with channel 36[1] through which air is blown. By this air the tobacco is blown out into discharge channel 37 in accurately determined quantities.

The apparatus according to this invention can also be used for the treatment of other fibrous materials in those cases where substantially the same problems exist as described above.

I claim:

1. A method of dosing long fibre tobacco comprising the steps of providing an approximate quantity of tangled long fibres, said approximate quantity being less than the quantity required, plucking tufts from the tangled mass of long fibres with the aid of needles gradually emerging from holes in a tangentially moving surface, which needles are brought into contact with the mass as it is fed therepast after which the needles are retracted to set the tufts free, subsequently providing a sufficient quantity of disentangled long fibres and adding a predetermined quantity of short fibres to the dosed portions of long fibres to make up said approximate quantity to the required quantity.

2. A method according to claim 1, characterized in that the tufts plucked out of the tangle of long fibres are compacted into a strand from which subsequently tufts of predetermined length are disengaged.

3. A method according to claim 2, characterized in that compacting is accomplished by vertically disposed conveyor belts enclosing a space, the cross-section of which gradually decreases in the direction of movement of the strand.

4. A method according to claim 3, characterized in that the conveyor belts are intermittently driven and the distance between them can be changed.

5. A method according to claim 3, characterized in that the conveyor belts are intermittently driven and the distance travelled by the belts is adjustable.

6. A method according to claim 5, characterized in that a change in the distance travelled by the conveyor belts or in the distance between them takes place in dependence upon the deviation shown by a plurality of tufts successively disengaged from the strand from the desired average weight.

7. A method according to claim 6, characterized in that part of the tufts of long fibres separated from the tangled mass is fed into a section of the apparatus, said section being provided with means to disentangle said tufts, preferably by a "carding" process.

8. A method according to claim 7, characterized in that the tufts of long fibres each time disengaged from the strand amount to 85–95% of the required quantity of long fibres and the quantity of disentangled long fibres added thereto amounts to 5–15% of said required quantity.

9. An apparatus for dosing tobacco fibres from a tangled mass of long and short fibres comprising means for separating the short fibres from the tangled mass of long fibres, means for measuring but an approximate quantity from the tangled mass of long fibres, said approximate quantity being less than the quantity required and means for measuring out a sufficient quantity of disentangled long fibres to make up said approximate quantity to the required quantity.

10. An apparatus for dosing tobacco fibres from a tangled mass of long and short fibres, comprising means for separating the short fibres from the tangled mass of long fibres, means for plucking out tufts from said tangled mass of long fibres, means for compacting the tufts into a strand, means for disengaging a predetermined length of said strand, means for weighing this length of said strand, and means for measuring out a weight of disentangled long fibres in dependence upon the weight of the length of said strand.

11. An apparatus according to claim 10, characterized in that the means for plucking tufts from the tangled mass of long fibres comprises a needle drum having needles moving into and out of the circumference of the drum during each revolution thereof and into the tangled mass of said fibres.

12. An apparatus according to claim 11, characterized in that the needle drum is disposed in a hopper and the plucked tufts of said material are fed through said hopper to a funnel branching into a main shaft and at least one laterally disposed secondary shaft, and horizontal conveyor belts connect to the funnel and lead to said laterally disposed secondary shaft, and means for driving said conveyor belts in opposite directions to each other.

13. An apparatus according to claim 12, characterized in that a feeding drum is disposed adjacent the end of each of the conveyor belts remote from the secondary shaft and the surface of the drums being concave.

14. An apparatus according to claim 12, characterized in that the wall of the shaft or funnel is provided with holes through which blocking needles can be passed.

15. An apparatus according to claim 10, characterized in that the means for compacting the tufts into a strand comprise a passage narrowing in the direction of transport which is essentially formed by four conveyor belts each turned through 90° in relation to each other and enclosing a passage which has a rectangular or square cross-section.

16. An apparatus according to claim 15, comprising an apparatus adapted to dose short fibres with a dosing disc having suction holes of variable depth, characterized in that the dosing disc is horizontally disposed at the bottom of a container with a vertical tobacco feed and a horizontal discharge channel.

* * * * *